US005480159A

United States Patent [19]

Alsip

[11] Patent Number: 5,480,159

[45] Date of Patent: Jan. 2, 1996

[54] GAME OF SKILL

[76] Inventor: Bruce F. Alsip, P.O. Box 10237, Bainbridge Island, Wash. 98110

[21] Appl. No.: 314,530

[22] Filed: Sep. 28, 1994

Related U.S. Application Data

[60] Division of Ser. No. 979,161, Nov. 19, 1992, abandoned, which is a continuation-in-part of Ser. No. 820,090, Jan. 13, 1992, abandoned.

[51] Int. Cl.[6] ..... A63F 9/00

[52] U.S. Cl. ..... 273/450

[58] Field of Search ..... 273/450, 449, 273/447; 446/325

[56] References Cited

U.S. PATENT DOCUMENTS

| | | | |
|---|---|---|---|
| 3,424,455 | 1/1969 | Dunson | 273/450 X |
| 4,327,911 | 5/1982 | Ptaszek et al. | 273/447 X |
| 4,932,655 | 6/1990 | Kurita . | |
| 5,007,636 | 4/1991 | Pagani . | |
| 5,265,884 | 11/1993 | Stein | 273/450 X |

FOREIGN PATENT DOCUMENTS

| | | | |
|---|---|---|---|
| 510581 | 8/1939 | United Kingdom . | |
| 2108001 | 5/1983 | United Kingdom | 446/325 |

*Primary Examiner*—Paul E. Shapiro
*Attorney, Agent, or Firm*—Jensen & Puntigam

[57] ABSTRACT

A method of playing a game which includes a base element having a substantially horizontal, dimensionally defined upper surface and a plurality of uniformly thick playing pieces, wherein the base element is placed on a stable surface and then the playing pieces are sequentially played forming a game structure extending upwardly and outwardly from the base element until a designated uppermost piece is played terminating any further upward play, all subsequent pieces being played outwardly, including wedging pieces between previously played pieces, until the structure topples.

6 Claims, 3 Drawing Sheets

FIG. 5
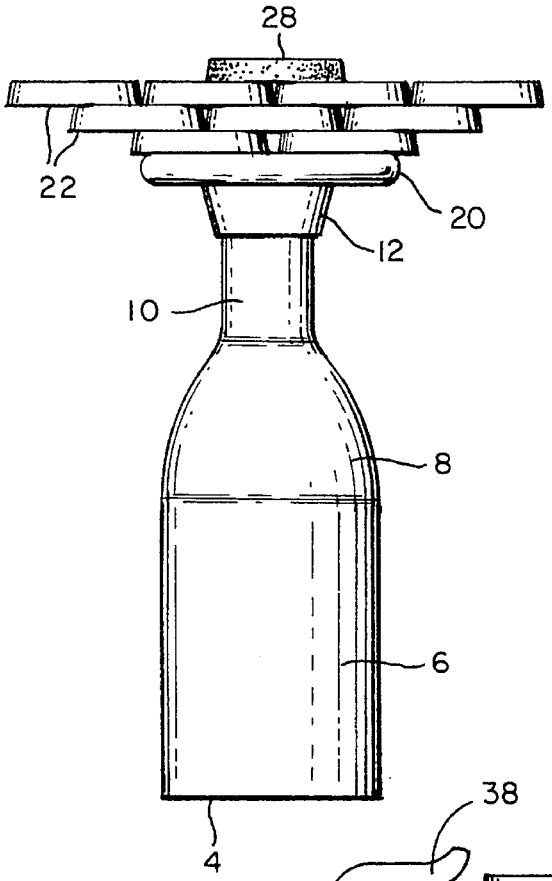
FIG. 6
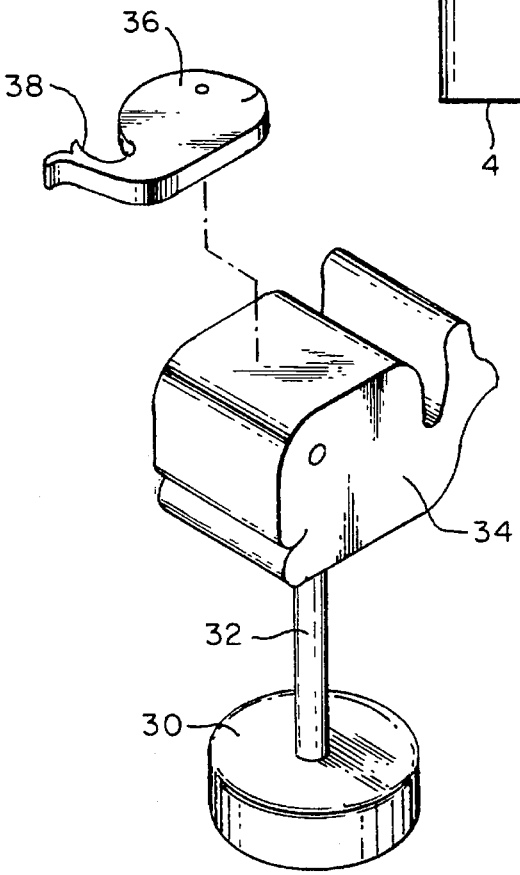
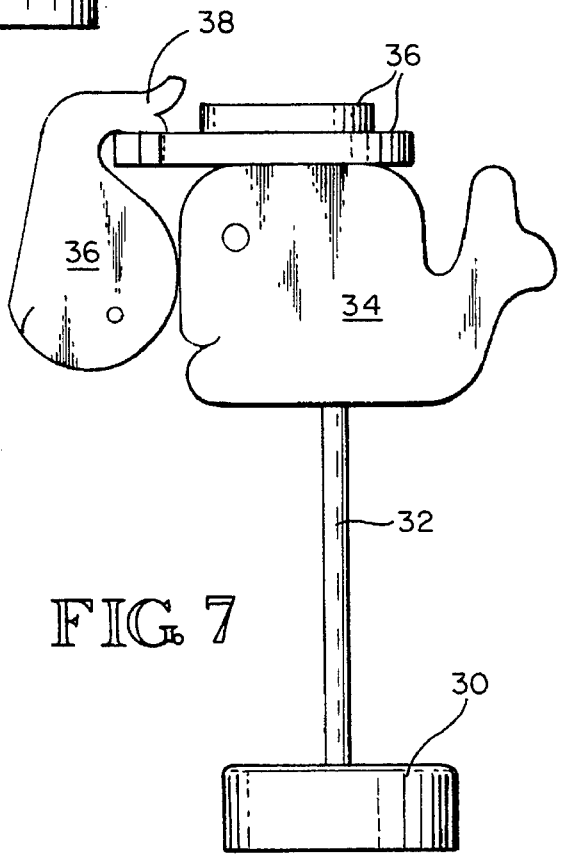
FIG. 7

GAME OF SKILL

This is a division of application Ser. No. 07/979,161, filed on Nov. 19, 1992, now abandoned, which is a continuation-in-part of application Ser. No. 07/820,090, filed Jan. 13, 1992, now abandoned.

TECHNICAL FIELD

This invention relates to a three-dimensional game of skill which requires a player to place a smooth playing piece upon a rigid supporting surface of a limited dimension in competition with other players who are likewise sequentially placing disks, or alternatively, as by oneself as a challenge. The loser is the person who dislodges one or more of the disks.

BACKGROUND ART

Games, to have lasting value and ongoing use, must provide sufficient variety to maintain interest of the players and sufficient challenge to spark competitiveness between the players.

The present game, because of its design, meets the two requirements in a unique fashion. Each player sequentially must place a smooth playing piece either directly or in a cantilever fashion upon the upper surface of a base member. The base member has a limited dimension thereby often requiring the subsequent players to use the weight of one or more of the playing pieces previously placed upon the platform to support his piece as he wedges it onto the playing surface or hangs it from an exposed ledge. The pieces, as they are stacked upon each other, create a downward pressure allowing multiple cantilevering outwardly and effectively increasing the size of the support surface. The players, by predetermined agreement, determine the total number of layers that may be placed upon the playing surface. The limitation upon the total number of layers has a direct relationship to the complexity and thus the competitiveness of the game.

Other games have used the principle of stacking or unstacking objects for their challenge. These games include games wherein a plurality of elongated objects are randomly in a pile and the object is to remove objects without disturbing others. Another variety is utilizing pieces of irregular configuration with the object being to stack as many as possible without toppling the structure. Games on the market which are included in these categories include Ta-Ka-Radi, Jenga and Topples.

Patented games which utilize similar rules include:

U.S. Pat. No. 4,932,655, granted to Kurita on Jun. 12, 1990, which discloses an elastic support upon which game pieces are stacked.

U.S. Pat. No. 5,007,636, granted to Pagani on Apr. 16, 1992, discloses a game apparatus for a variety of games, including an unstable platform upon which playing pieces are stacked.

British Patent 510581, granted Aug. 3, 1939, discloses a game wherein sticks are stacked on top of a cup.

With the above-noted prior art in mind, it is an object of the present invention to provide a multi-dimensional game requiring strategy and skill.

Another object of the present invention is to provide a game which may be played equally well by participants of various ages.

Still a further object of the present invention is to provide a game which incorporates the basic theory of balance.

Still a further object of the present invention is to provide a game which may be played by individuals or, in the alternative, by a group of players taking alternate turns.

Yet another object is to provide a challenging game for a single player.

BRIEF DESCRIPTION OF THE DRAWINGS

FIG. 5 is a side elevation of the inventive game during play.

FIG. 6 is a pictorial representation of another version of the inventive game.

FIG. 7 is a side elevational view of the apparatus of FIG. 6 depicting another way of securing playing pieces.

BEST MODE FOR CARRYING OUT THE INVENTION

Figure 1:
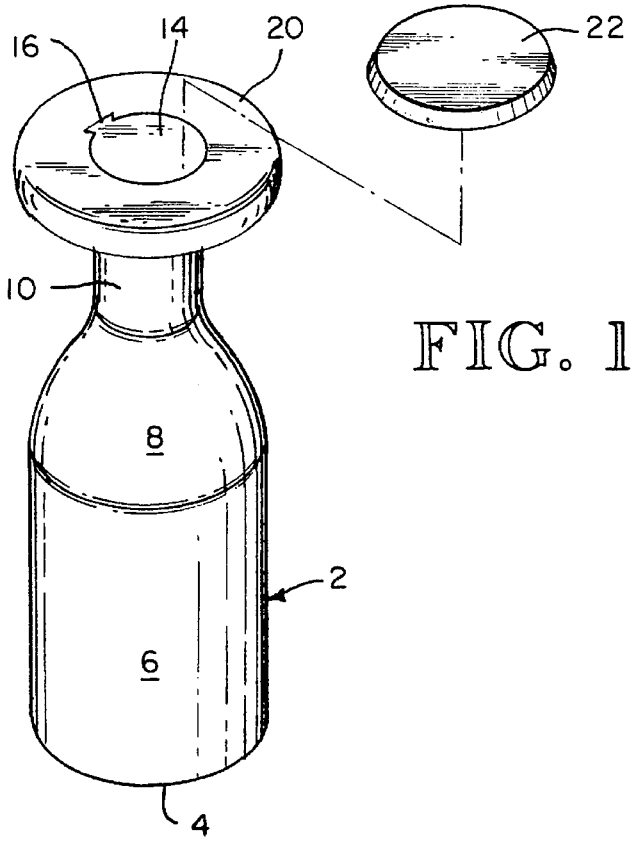
FIG. 1 is a pictorial representation of one version of the game showing the base member, the playing platform and a single playing piece in exploded fashion.
Figure 2:
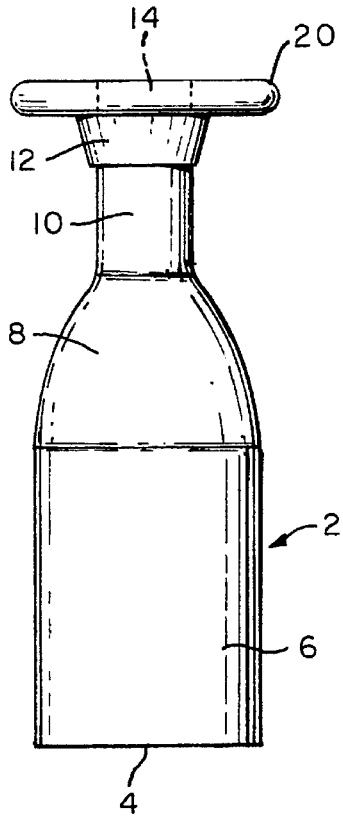
FIG. 2 is a side elevation view of the base member.
Figure 3:
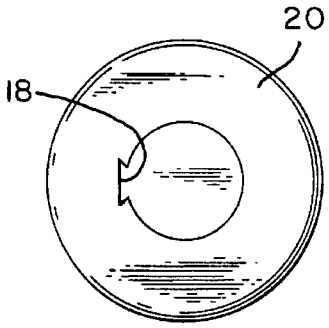
FIG. 3 is a plan view of the playing platform which is supported by the base member.

As seen in FIG. 1, the base member 2 has a flat bottom 4, a cylindrical main body portion 6, an inwardly curved upper main body portion 8 leading to a neck 10 and, as seen in FIG. 2, terminates with an outwardly projecting flared portion 12. A cylindrical projection 14 extends upwardly therefrom and may include a key element 16 which interlocks with a congruent slot 18 in the actual playing surface 20 which sits on top of a ledge formed by the different diameter portions 12 and 14 and is prevented from rotating by the key 16 and the slot 18. The game may also be played wherein the playing surface is free to rotate. The playing surface may include a smooth upper surface by being truly a cap having the neck receiving portion extend only partially through the element. Also seen in this view is a representative playing piece 22 which is generally circular when seen in plan view.

The playing pieces for this version are thin cylindrical sections taken perpendicular to the axis.

Figure 4:
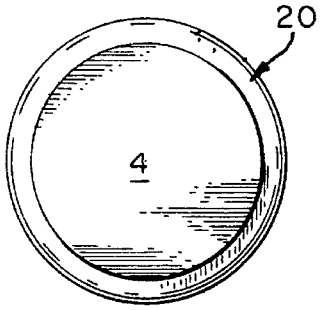
FIG. 4 is a plan view of a typical playing piece.
Figure 8:
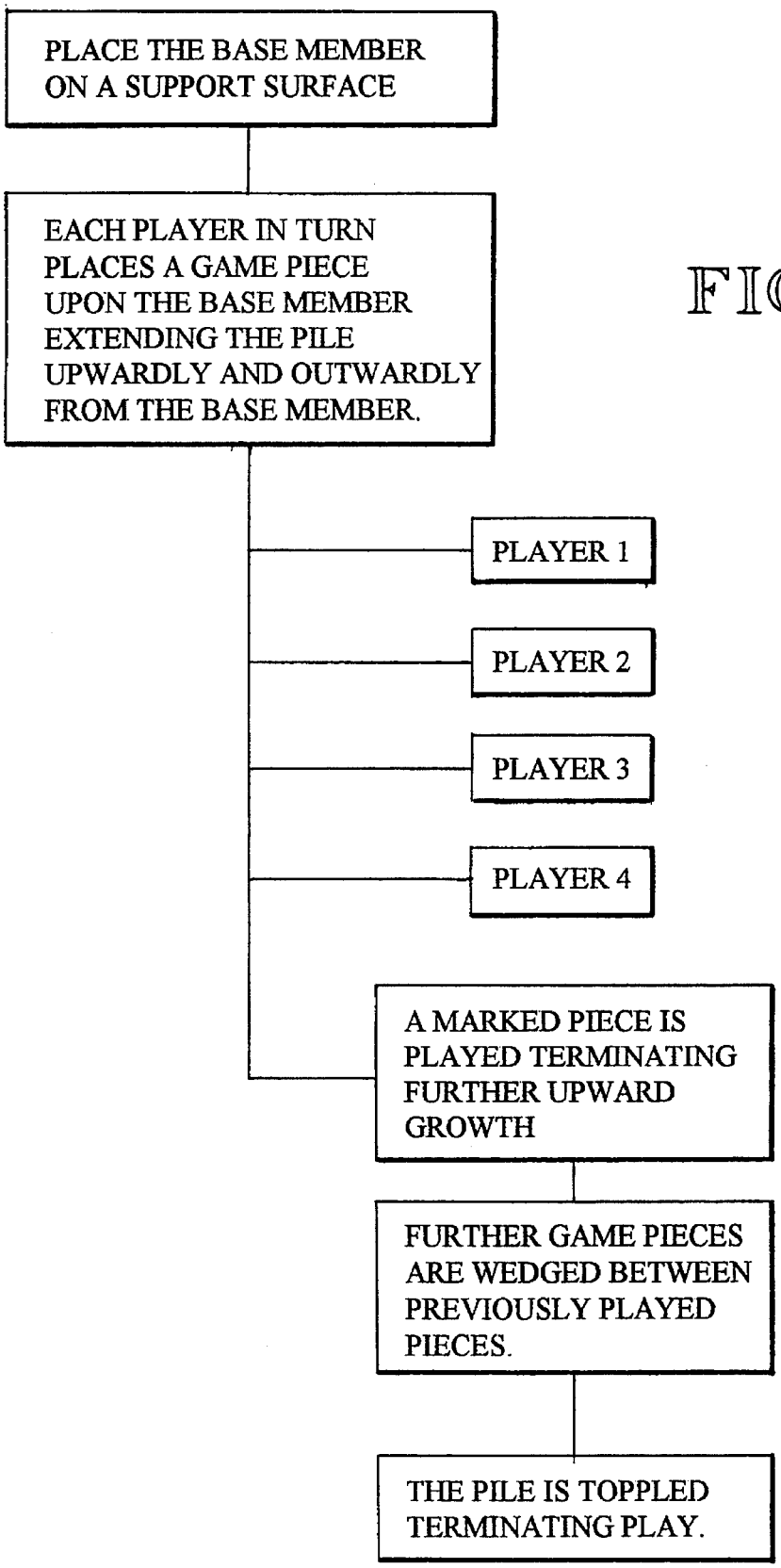
FIG. 8 is a flow chart depicting the steps of a method of using the game apparatus.

The game pieces are likewise seen in FIGS. 1, 4 and 5, wherein identical identifying members are used to denote the portions of the piece.

Reference is now made to FIG. 5 where it can be seen that the player or players have placed a plurality of playing pieces 22 upon the top of playing surface 20, keeping in mind that a specially marked playing piece 28 designates the upper limitation of play and thus controls the complexity of the game.

Reference is now had to FIG. 6 wherein an alternate game apparatus is shown. As seen in this view, the apparatus includes a base member 30 having a vertically extending, rigid rod member 32 upon which is mounted a top element 34 which is depicted in the configuration of a profile of a whale; but it is to be understood that the configuration could be of any object as long as it has a flat, stable upper surface upon which the playing pieces may be stacked and cantilevered. Also seen in this view is a playing piece for this particular configuration, which likewise is a configuration of a profile of a whale in the shape of a flat disk 36, having a main body portion and a tail portion 38.

Reference is now had to FIG. 7, wherein a side elevational view is shown depicting the present game apparatus wherein one of the game pieces 36 has been depicted as being suspended by its tail 38.

It is to be understood that the configuration of the base and the playing pieces are illustrative only and that the playing pieces could be in the configuration of animals, birds or fish, to be more attractive to children.

Thus as can be recognized, the present invention provides interest and challenge while also having an appealing appearance.

I claim:

1. A method of game play comprising assembling a base member on a supporting surface, said base member having an upper surface and being assembled on said supporting surface such that said upper surface is in a substantially horizontal disposition, assembling a plurality of playing pieces on said base member to form a game structure, said playing pieces including closely spaced substantially parallel opposite surfaces and being assembled such that the opposite surfaces thereof are substantially parallel to said base member upper surface, said playing pieces being assembled in said game structure such that at least some of said playing pieces are captured in cantilevered relation between at least two other playing pieces, said playing pieces being assembled so as to extend said game structure both upwardly and laterally outwardly from said base member, one of said playing pieces being designated as an uppermost playing piece and being assembled to define an uppermost point in said game structure, said method further comprising assembling a plurality of additional playing pieces in said game structure after assembling said uppermost playing piece therein, said additional playing pieces being assembled in said game structure at locations which are disposed laterally outwardly from and below said uppermost playing piece.

2. In the method of claim 1, the opposite surfaces of said playing pieces being smooth and flat, at least a portion of the playing pieces which are captured in cantilevered relation being assembled by inserting them between two previously assembled playing pieces.

3. In the method of claim 1, said base member upper surface having an outer perimeter, at least a portion of said game pieces being assembled in said game structure at locations which are entirely outside of a vertical projection of said outer perimeter.

4. The method of claim 3 further comprising assembling a plurality of hanging members in said game structure so that said hanging members extend downwardly from a portion of said games pieces and so that a portion of said hanging members are located entirely outside of the vertical projection of said outer perimeter.

5. The method of claim 1 further comprising assembling a plurality of hanging members in said game structure so that said hanging members extend downwardly from at least a portion of the game pieces which are captured in cantilevered relation.

6. A method of game play as in claim 1, wherein said additional playing pieces are wedged between previously placed playing pieces.

* * * * *